United States Patent [19]

Banks et al.

[11] Patent Number: 4,508,156

[45] Date of Patent: Apr. 2, 1985

[54] PERSONALIZED ITEMS AND PROCESS FOR MAKING THEM

[75] Inventors: Julia G. Banks; William Ficho, both of Chicago, Ill.

[73] Assignee: Vasilia Ltd., Chicago, Ill.

[21] Appl. No.: 425,384

[22] Filed: Sep. 28, 1982

[51] Int. Cl.[3] ..... B22C 9/02; A44C 25/00

[52] U.S. Cl. ..... 164/35; 29/160.6; 63/23; 101/401.1; 433/71; 433/229

[58] Field of Search ..... 164/34, 35; 433/71, 433/229; 63/23; 29/160.6

[56] References Cited

U.S. PATENT DOCUMENTS

| | | | |
|---|---|---|---|
| 964,499 | 7/1910 | Delabarre | 164/35 |
| 1,303,545 | 5/1919 | Downie | 433/71 |
| 2,183,624 | 12/1939 | Schwartz | 433/71 |
| 2,933,811 | 4/1960 | Lifton | 433/71 X |
| 3,064,354 | 11/1962 | Pos | 433/71 |
| 4,019,253 | 4/1977 | Hazar | 433/71 |

*Primary Examiner*—F. Barry Shay

*Attorney, Agent, or Firm*—Laff, Whitesel, Conte & Saret

[57] ABSTRACT

A metal charm has the impression of the biting edges of teeth formed in it. It may also be formed in a rubber stamp.

5 Claims, 4 Drawing Figures

PERSONALIZED ITEMS AND PROCESS FOR MAKING THEM

This invention relates to personalization items and to the process for making such items and more particularly to personalization of charms, rubber stamps, personal stationary, cards, T-shirts, or the like.

Sometimes, people want something which is very personal to them, to use as a gift to a loved one, as an ego trip, or the like. Of course, there are other reasons for having such personalized items. Sometimes, the personalization may go so far as to establish and prove the identity of the individual who is being personalized. For example, a thumbprint or fingerprint, a detailed photograph of an ear or an iris are all items which establish personal identity beyond any doubt.

This personalization may be incorporated into a charm which is a small statue, metal casting, or the like, which may be worn on a chain, bracelet, key ring, or the like. Of course, a rubber stamp may be made with these and many different embossments. All of these and many similar items may be personalized with something which is unique to the individual who is using or wearing it. Heretofore, these "personalized" items have not been truly personalized. For example, a grandmother's bracelet is usually standarized silhouette of a boy's or a girl's head with a name and a birthdate engraved on it. All grandmothers get the same silhouette. That is not really personalized.

One of the ways of positively identifying people is by their teeth. There are no two sets of teeth which have exactly the same wear marks, tooth alignment and spacing and the like. Accordingly, if people should wish to exchange truly personalized, everlasting gifts which no one else can match, they may give a one-of-a-kind gift by exchanging a metal casting containing impressions made by their teeth.

Accordingly, an object of the invention is to enable people to have a truly, one-of-a-kind personalized item, which is unique to them and to them alone.

The attached drawing shows two embodiments of the invention wherein.

Figure 1:
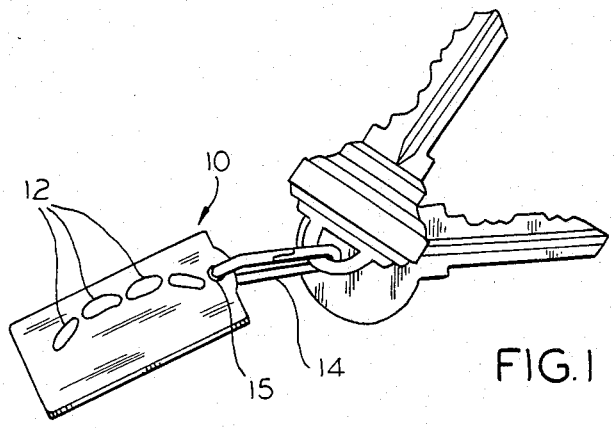
FIG. 1 is a perspective view of cast metal charm, on a key ring with the impression of a unique human bite.

In FIG. 1, a charm 10 is shown as having teeth marks 12 which were originally made by an individual biting into a wax master blank. As here shown, the charm 10 has a mounting hole 15 by which it is mounted on a key ring 14, but it could also be worn as a pendant on a necklace, a charm on a bracelet, or the like, hung from some other supporting structure. Conveniently, the wax may be conventional dental wax of a type used by most dentists who are constructing an inlay or denture, for example. Preferably, the wax is then encased in a plaster mold, which may be heated to melt the wax and leave a cavity in the impression of the dental wax. Thereafter, a centrifugal casting process is used to form the charm.

Figure 2:
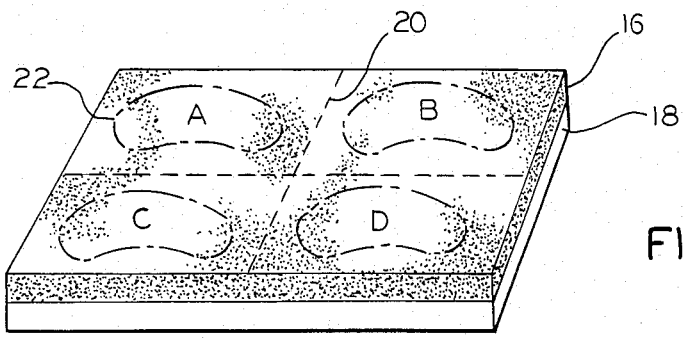
FIG. 2 is a combination of a dental wax and cardboard element used in a process step during a practice of the inventive process.

In greater detail, the process for making these teeth or bite impressions is as follows:

(a) When an order is received by a manufacturer, a kit in a plastic or cardboard container is mailed or otherwise given to the customer. The kit includes a combination of dental wax 16 (FIG. 2) formed as an overlay on a cardboard tray 18. The wax is preferably sectionalized, as indicated by dashed lines 20 to provide separate impression areas, A–D.

(b) The customer gently removes the wax 16 and cardboard 18 from the container.

(c) Before biting into the wax:

1. The customer makes sure that the wax is at room temperature for both easier handling and to prevent cracking, which could occur if the wax is too cold.
2. The customer makes sure that the cardboard is on the bottom of the wax so that the lower teeth will not press through and emboss the wax.
3. The customer should also be sure that he does not have a loose tooth, cap or filling.

(d) Next, the customer bites down gently and firmly on the top of the wax 16, without biting completely through the wax. Usually, the best charm will result from a use of the front four-to-six teeth; however, this is not essential. The customer might prefer to use molars. The customer may practice on a stick of chewing gum to get the "feel" for how the bite will look and to discover the impression which he prefers. On certain bites, it may help to slightly angle the wax upwardly and out when pressing the wax against the upper teeth.

(e) The customer follows any suitable marks formed on the wax to make a number of separate impressions of his teeth as by biting into each of the areas A–D.

(f) Once the impressions are made, the wax is replaced into the container, and the preferred impression is identified for the manufacturer to copy.

(g) Then, the container is returned to the manufacturer, with the wax impressions.

(h) The manufacturer opens the container, removes the wax, and casts the wax in any suitable material, such as gold, silver, pewter, brass or plastic.

(i) The casting is preferably made by:

1. Investing the dental wax with the selected impression in a plaster mold.
2. Melting the wax and draining it from the plaster mold.
3. Casting molten metal into the cavity formed when the melted wax is drained from the mold. A centrifulagl casting process may be used.

Sometimes, it may be desirable to trim, model, or form the wax before casting the charm. For example, dot-dashed line 22 (FIG. 2) indicates that the charm will have a free form. The impression 24 in wax could, of course, be mounted on any suitable supplemental auxiliary wax mandrel or base 26, such as a heart, popular symbol, or the like.

Figure 3:
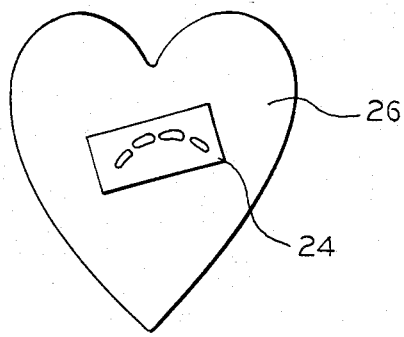
FIG. 3 shows the charm with an impression of teeth mounted on an auxiliary base.
Figure 4:
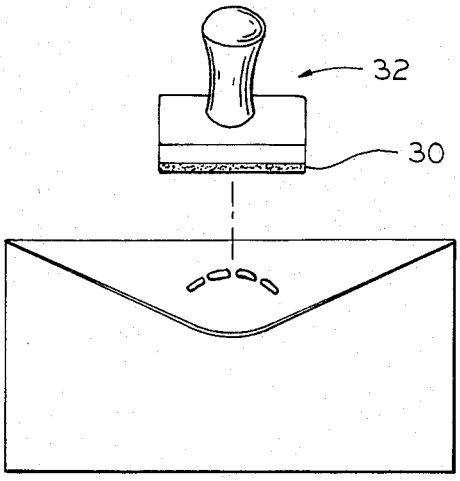
FIG. 4 is a rubber stamp for leaving an impression of the teeth mark.

On some occasions, the impression may be made in the form of a die 30 (FIG. 3) for a rubber stamp 32. Here, the user may apply an ink impression of his own teeth on a personalized item, such as an envelope. The rubber stamp 32 may be self inking. In addition, a kit is provided which includes a note pad, envelopes and the like which are preprinted in a manner which cooperates with the rubber stamp impression to further highlight the personalization of the rubber stamp.

Those who are skilled in the art will readily perceive how to modify the invention. Therefore, the appended claims are to be construed to cover all equivalent structures which fall within the true scope and spirit of the invention.

The claimed invention is:

1. A process using a mailer kit for making a do-it-yourself impression of human teeth in order to create an item in the form of a metal charm with personalization, said process comprising the steps of:

a. forming an impression blank comprising a layer of wax which takes an impression of teeth responsive to a bite on said blank at room temperatures, said wax layer being formed as an overlay on a layer of cardboard, said layer of wax having a uniform thickness across the surface of said cardboard substantially equal to the tip ends of the biting edges of human teeth, whereby said cardboard precludes anymore than said tip ends from making an impression in said wax;

b. biting into the top of said wax layer as far as said cardboard in order to create impressions of the tip biting edges of teeth while using the cardboard to establish and to limit the depth of a bite and to preclude embossing the bottom of said wax layer with opposing teeth; and c. casting the impression of the wax layer into a metal charm.

2. The process of claim 1 and the added step of sectionalizing said wax layer to enable said mailing kit to include means for creating a plurality of impressions in step (b) in case the do-it-yourself impressions do not work out on the first impression.

3. The process of claim 1 and the added step of forming the shape of said wax layer into a plate of an artistic overall shape bearing the impression of the teeth before the casting.

4. The process of claim 3 and the added step of supplementing the wax superimposing of step (b) by superimposing it upon a wax mandrel for providing a base plate of an auxiliary design.

5. A metal charm made by the process as defined in claim 1.

* * * * *